US005607277A

United States Patent [19]

Zopf

[11] Patent Number: 5,607,277

[45] Date of Patent: Mar. 4, 1997

[54] AUTOMATED INTERMEDIATE CONTAINER AND METHOD OF USE

[75] Inventor: William D. Zopf, Chattanooga, Tenn.

[73] Assignee: The Heil Co., Chattanooga, Tenn.

[21] Appl. No.: 387,224

[22] Filed: Feb. 13, 1995

Related U.S. Application Data

[63] Continuation-in-part of Ser. No. 189,406, Jan. 31, 1994, Pat. No. 5,484,245, which is a continuation of Ser. No. 877,488, May 1, 1992, abandoned.

[51] Int. Cl.[6] ..... B65F 3/04

[52] U.S. Cl. ..... 414/408; 414/422

[58] Field of Search ..... 414/406, 408, 414/409, 422, 501, 547, 549, 551–555, 740, 741, 732

[56] References Cited

U.S. PATENT DOCUMENTS

| | | | |
|---|---|---|---|
| 2,480,959 | 9/1949 | Presnell | 414/547 |
| 3,576,265 | 4/1971 | Brady | 414/408 X |
| 3,662,910 | 5/1972 | Herpich et al. | 414/406 |
| 3,762,586 | 10/1973 | Updike, Jr. | 414/408 |
| 3,822,802 | 7/1974 | Evan, Jr. | 414/501 |
| 4,363,588 | 12/1982 | Stickney | 414/408 |
| 5,333,984 | 8/1994 | Bayne et al. | 414/408 |

FOREIGN PATENT DOCUMENTS

| | | | |
|---|---|---|---|
| 0405428 | 1/1991 | European Pat. Off. | 414/408 |
| 1531763 | 1/1970 | Germany | 414/408 |
| 9100231 | 1/1991 | WIPO . | |

*Primary Examiner*—James W. Keenan

*Attorney, Agent, or Firm*—Parsons & Goltry; Robert A. Parsons; Michael W. Goltry

[57] ABSTRACT

An intermediate container which may be attached to a lift assembly of a refuse vehicle, and having a remotely controlled motor powered assembly attached thereto for emptying refuse containers. The motor powered assembly includes an extendible arm coupled to the intermediate container, a dump assembly coupled to the extendible arm, and an engagement assembly coupled to the dump assembly.

5 Claims, 14 Drawing Sheets

FIG. 11
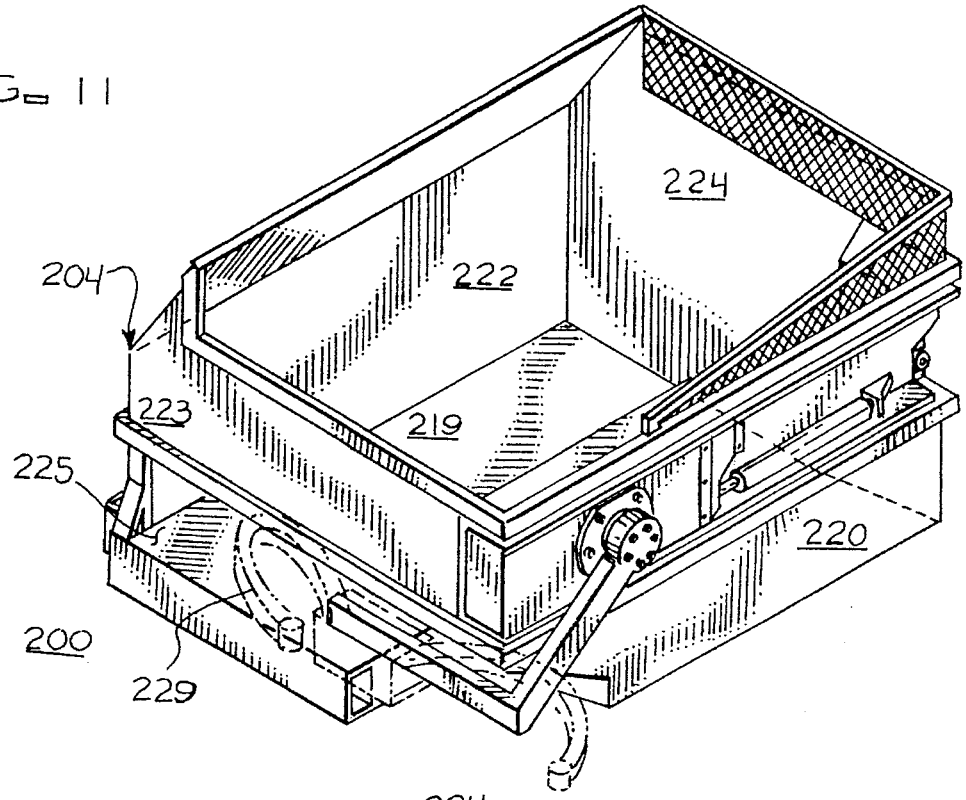
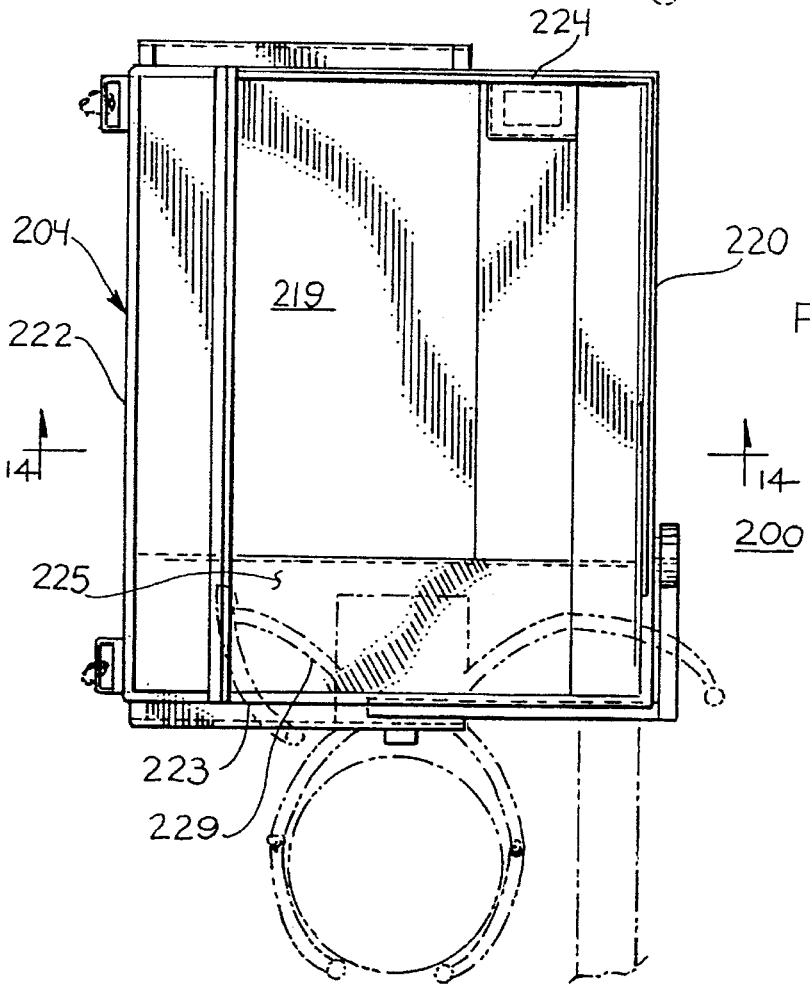
FIG. 12

200
204
205
225
227
228
229
230
237
238
239
240
242
243
244
245
247

248
257
250
237
228
278
279
253
254
249
257
252
282
277
280
256
242
266
276
255
263
293
265
205
262
268
305
258
267
261
295
303
288
289
298
272
270
269
238
287
297
275
260
264
273
274
230
290
292
300
294
304
302
243
245
244

AUTOMATED INTERMEDIATE CONTAINER AND METHOD OF USE

This application is a continuation-in-part of U.S. patent application Ser. No. 08/189,406, now U. S. Pat. No. 5,484, 245 which was filed on 31 Jan. 1994, which was a continuation of U.S. patent application Ser. No. 07/877,488 filed 1 May 1992, now abandoned.

BACKGROUND OF THE INVENTION

1. Field of the Invention

This invention relates to refuse collection devices.

More particularly, the present invention relates to refuse vehicles utilizing automated systems for dumping containers.

In a further more specific aspect, the instant invention concerns a sidearm assembly on an intermediate container for a front end loading refuse vehicle 2. Prior Art The disposal of refuse has always been a problem in populated areas. This problem has increased with the filling and closure of land fills. Generally, refuse collected by individual households are stored in a relatively small can or refuse container. Periodically these containers are placed so they can be dumped into a larger container and transported to a land fill or other refuse destination. There are a number of devices for collecting refuse from these relatively small containers. A truck is generally employed, having a large bin into which the containers are emptied. Many vehicles employ compactors which compact the refuse collected in the bins. The refuse is transferred into the bin in a large variety of different ways. The individuals operating the trucks can simply pick up the smaller containers and dump them into the vehicle, or mechanical assemblies can be used to dump the containers into the bin.

Each of these methods have problems associated with them. When the truck operators dump the containers by hand, the size and weight of the containers when full are limited to a size easily handled by an average man. For many households, this requires more than one container, since all of the accumulated refuse may not fit in one of the relatively small containers. Therefore, it takes considerable time to collect the refuse from each stop.

When mechanical devices are used to dump the containers, larger cans may be used requiring only a single transfer of refuse at each stop. However, these mechanical devices, usually consisting of arms which close around the container, are very expensive and require specialized vehicles. Furthermore, while these vehicles may be satisfactory for collecting refuse in rural areas where refuse collection points are widely separated, in urban areas having collection points much closer together, the need to dump each individual load from each collection point into the main bin of a vehicle is inefficient. It generally requires a great deal of time for a collection device to cycle through its entire collection process. A further problem with these collection devices is that only relatively small containers can be dumped. Due to the large volume of refuse, small individual refuse containers would be impractical for industries and large housing complexes. Therefore, large dumpsters are generally used to collect refuse. However, these dumpsters cannot be collected and dumped by the same vehicle which dump the smaller containers. Therefore specialized vehicles, which have hydraulically operated arms capable of engaging the large dumpsters and emptying them in their refuse bin must be used. The vehicle generally loads from the front, since the driver must be able to see the dumpsters in order to engage the dumpsters with the arms. Again, these vehicles are very expensive and specialize in the large dumpsters. This specialization prevents them from collecting and dumping smaller containers.

Therefore, a refuse collection company collecting refuse from large housing complexes such as apartments and from industry as well as from individual homes, would require at least two types of trucks. This can significantly increase the cost of operation.

It would be highly advantageous, therefore, to remedy the foregoing and other deficiencies inherent in the prior art. Accordingly, it is an object of the present invention to provide and new and improved refuse collection device.

Another object of the instant invention is to provide a new method of collecting refuse.

And another object of the present invention is to provide a refuse collection device which will convert a vehicle which normally collects large dumpsters into a vehicle which can collect smaller containers.

Still another object of the present invention is to provide a refuse collection device which would reduce the amount of time required for refuse collection.

Yet another object of the invention is to provide a refuse collection device which would promote more efficient use of equipment.

Yet still another object of the invention is to provide a relatively inexpensive attachment, as opposed to providing a separate vehicle.

A further object of the instant invention is to provide a refuse collection device which facilitates the dumping of heavy garbage containers.

And a further object of the present invention is to provide a new and improved grabber assembly for refuse collection devices.

Yet a further object of the present is to provide a refuse collection device which allows a front end loader to be loaded from the side.

SUMMARY OF THE INVENTION

Briefly, to achieve the desired objects of the instant invention in accordance with the preferred embodiment thereof, provided is an automated intermediate container for use with a refuse collection vehicle. The refuse collection vehicle includes a lift device coupled to the refuse collection vehicle for raising said automated intermediate container. The automated intermediate container includes an intermediate container attachable to the lift device and a sidearm assembly coupled to the intermediate container for emptying refuse into the intermediate container. The side arm assembly includes an extendible arm coupled to the intermediate container and having a terminal end. A tilt assembly for up ending the refuse container so as to empty its contents into the intermediate container is coupled to the terminal end of the extendible arm. A grabber assembly which engages the refuse container is coupled to the tilt assembly.

A method for collecting refuse includes the steps of providing a refuse collection vehicle having a lift device, an intermediate container coupled to the lift device and a sidearm assembly coupled to the intermediate container. The refuse collection vehicle is then positioned adjacent a refuse container and the sidearm assembly is activated to engage the refuse container and empty it into the intermediate container.

BRIEF DESCRIPTION OF THE DRAWINGS

The foregoing and further and more specific objects and advantages of the instant invention will become readily apparent to those skilled in the art from the following detailed description of the preferred embodiment thereof, taken in conjunction with the drawings, in which.

Figure 8:
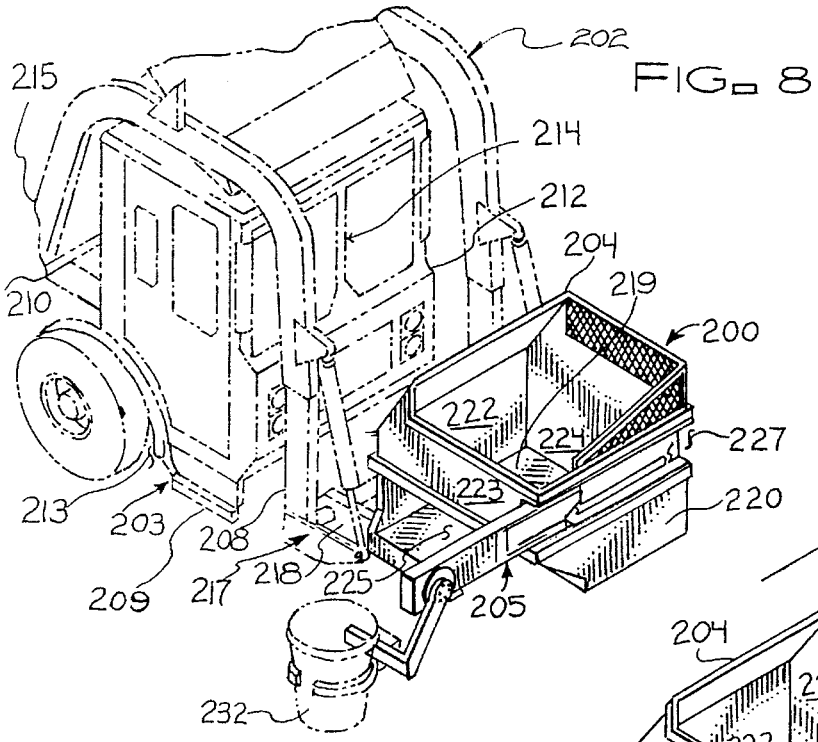
Figure 9:
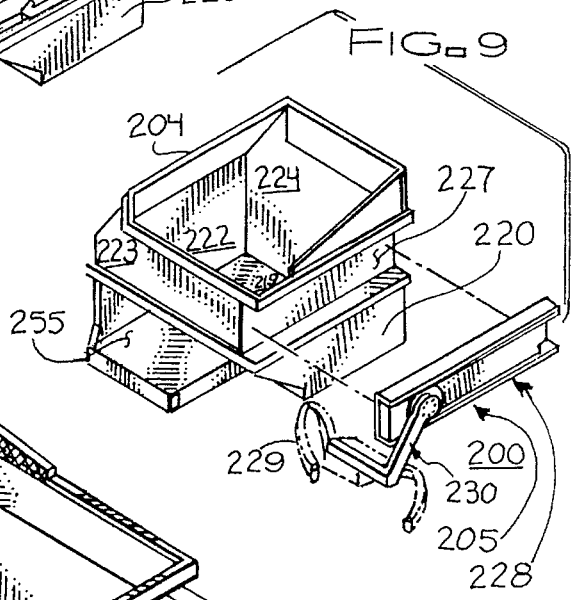
Figure 10:
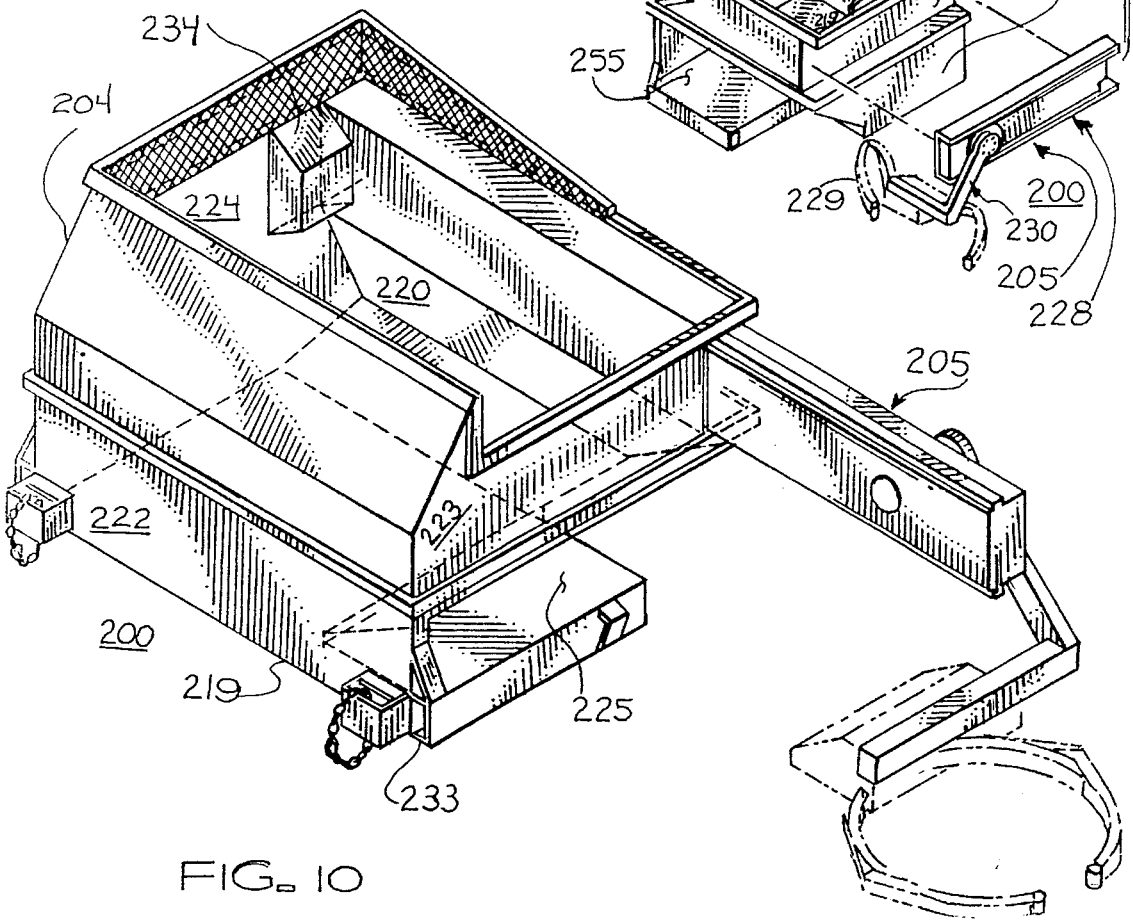
Figures 13, 14:
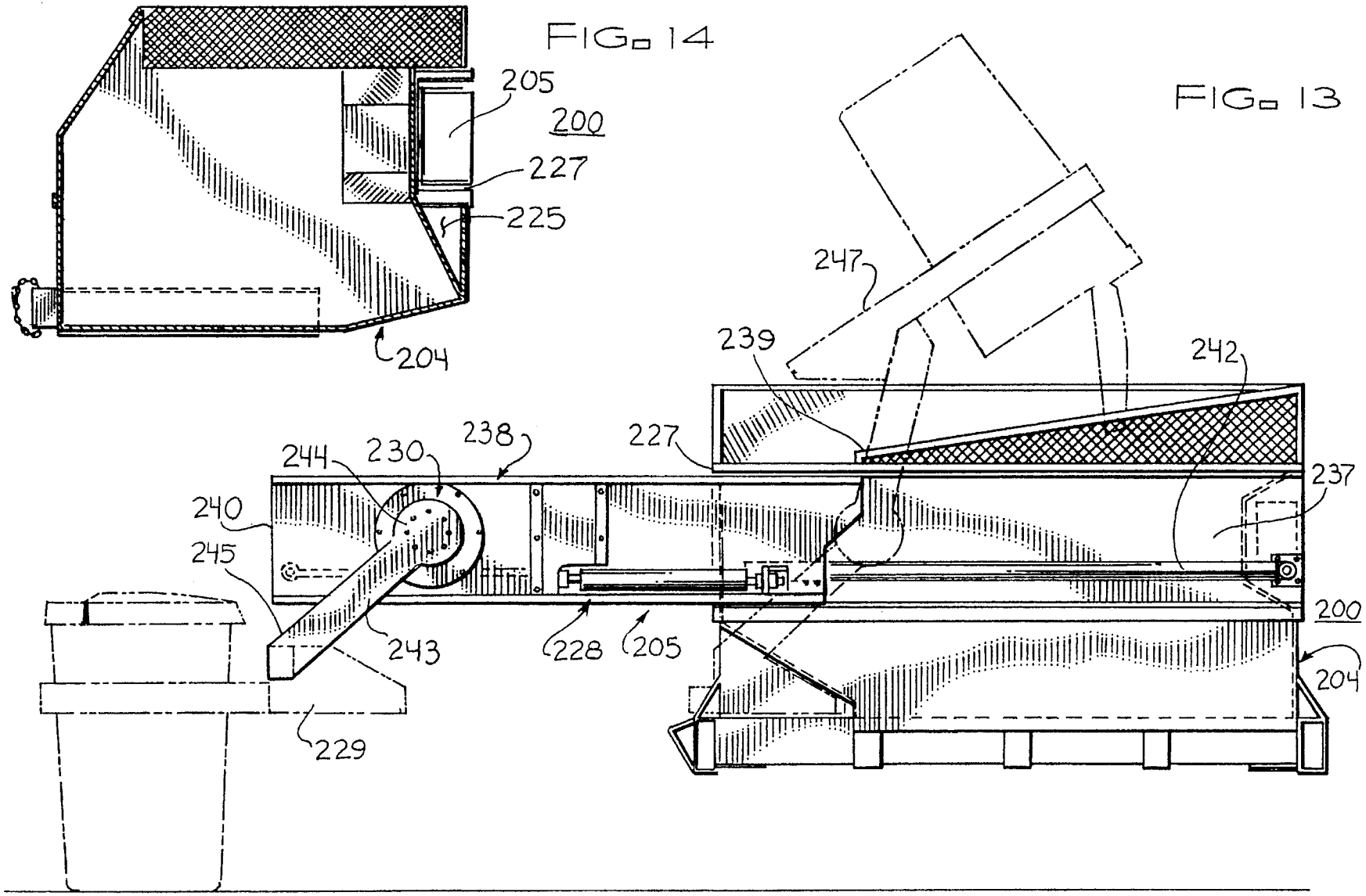
Figure 15:
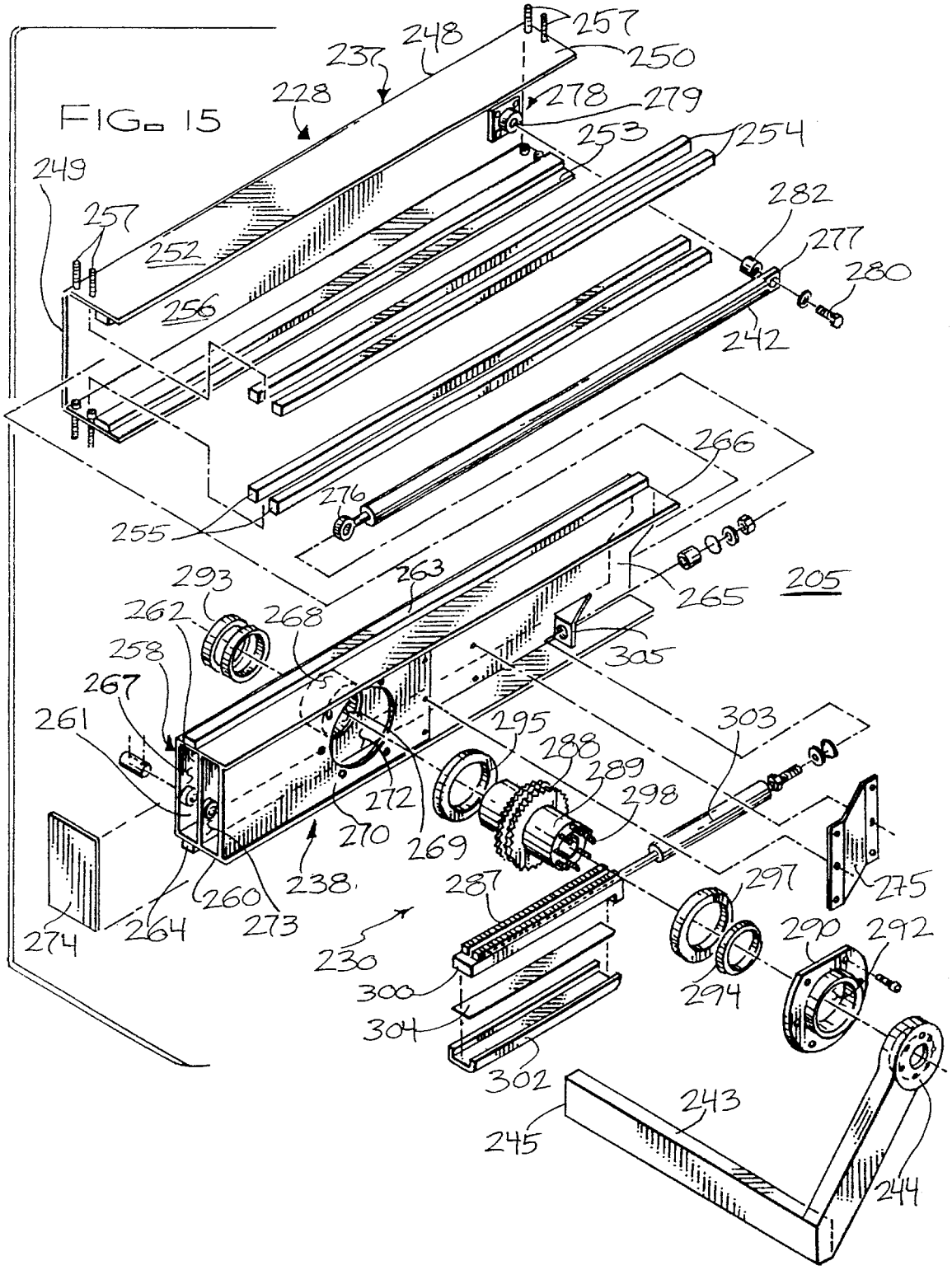
Figure 16:
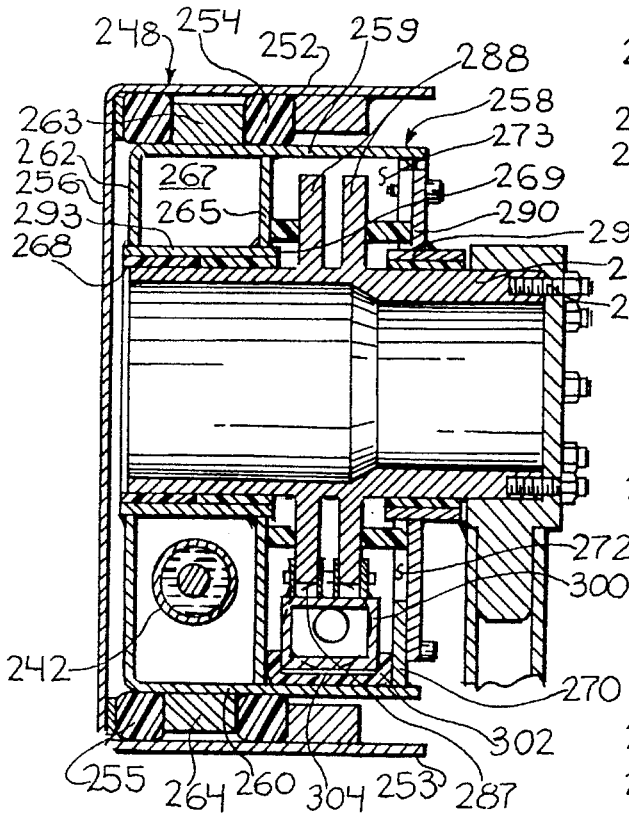
Figure 17:
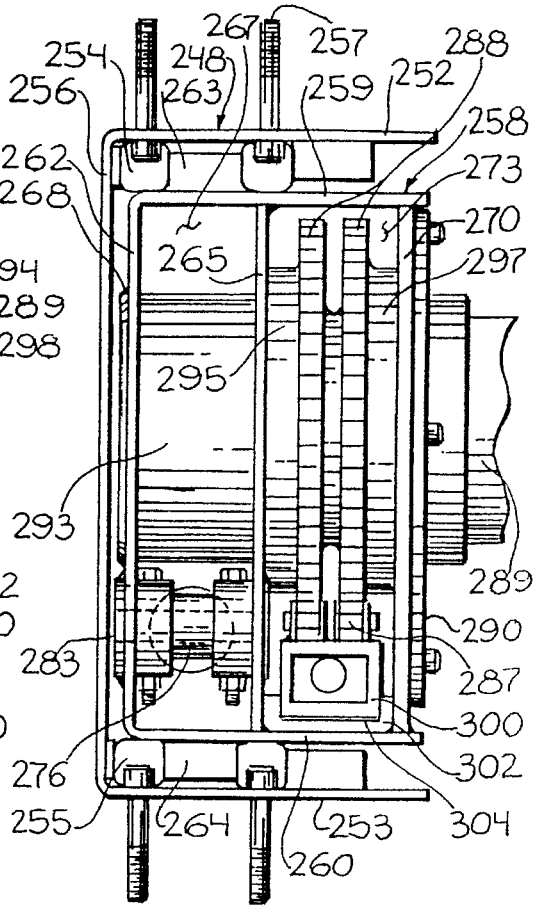
Figure 18:
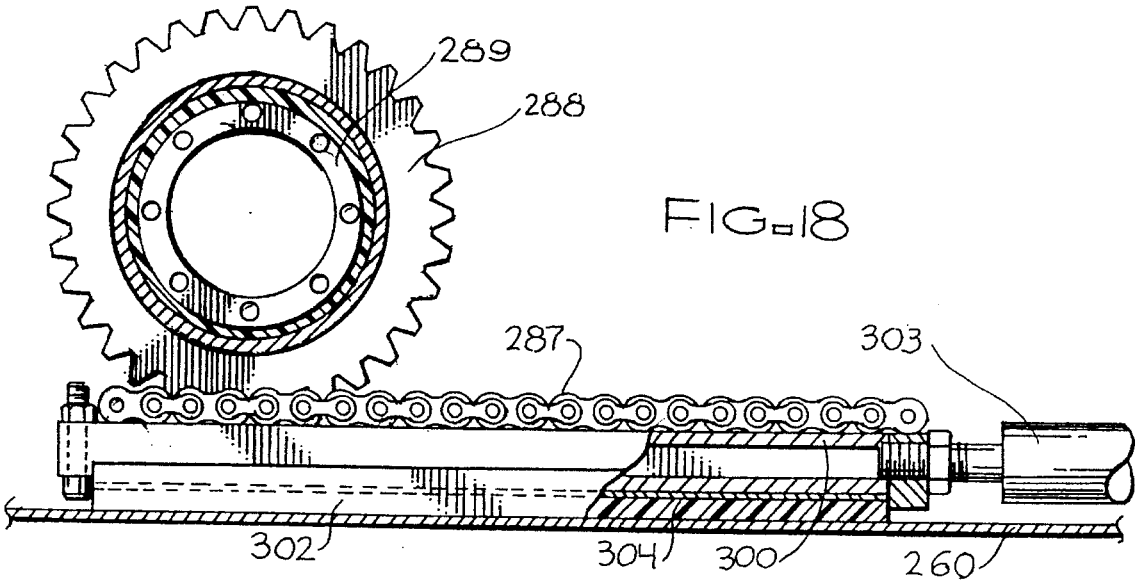
Figure 19:
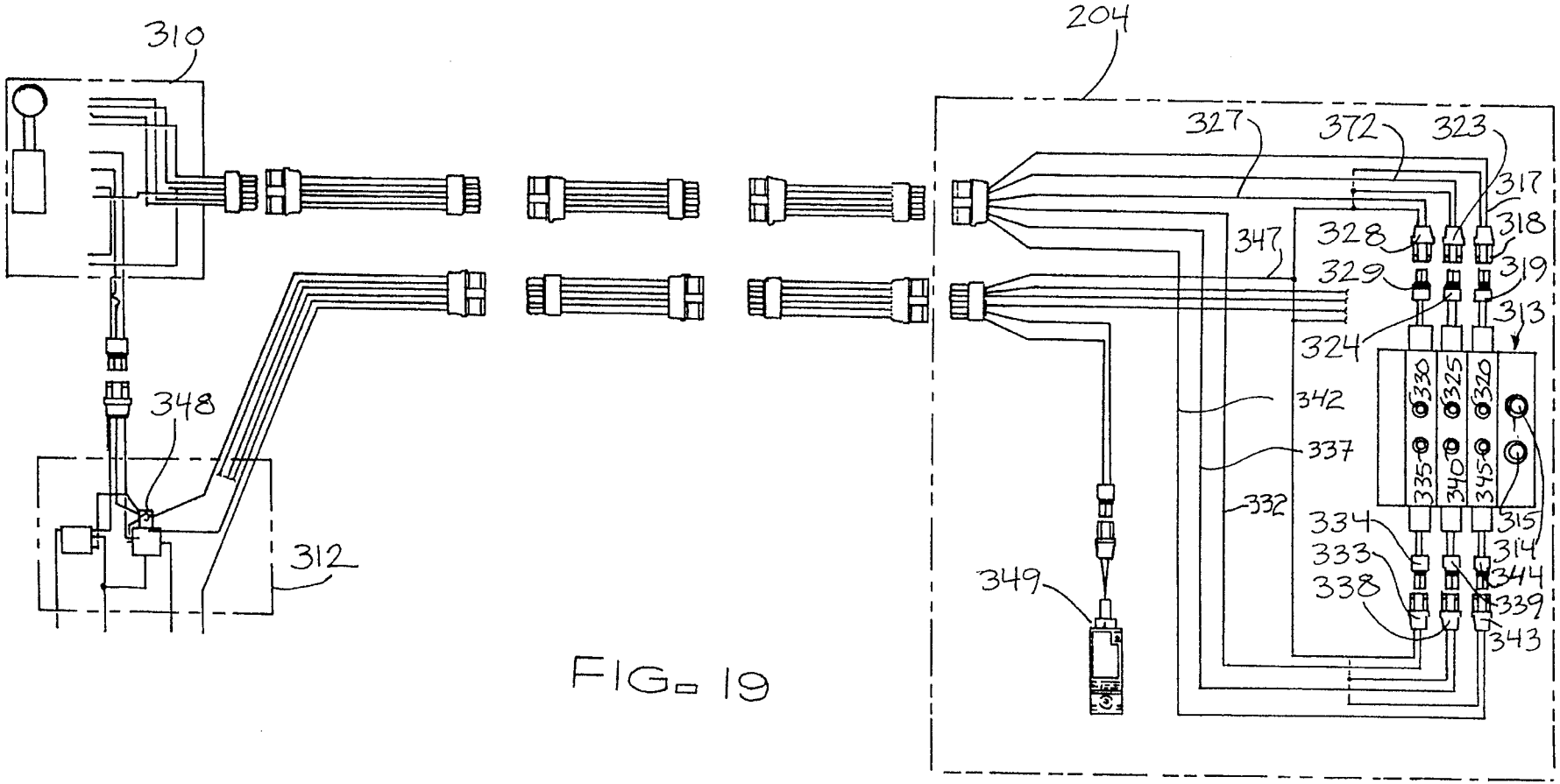
Figure 20:
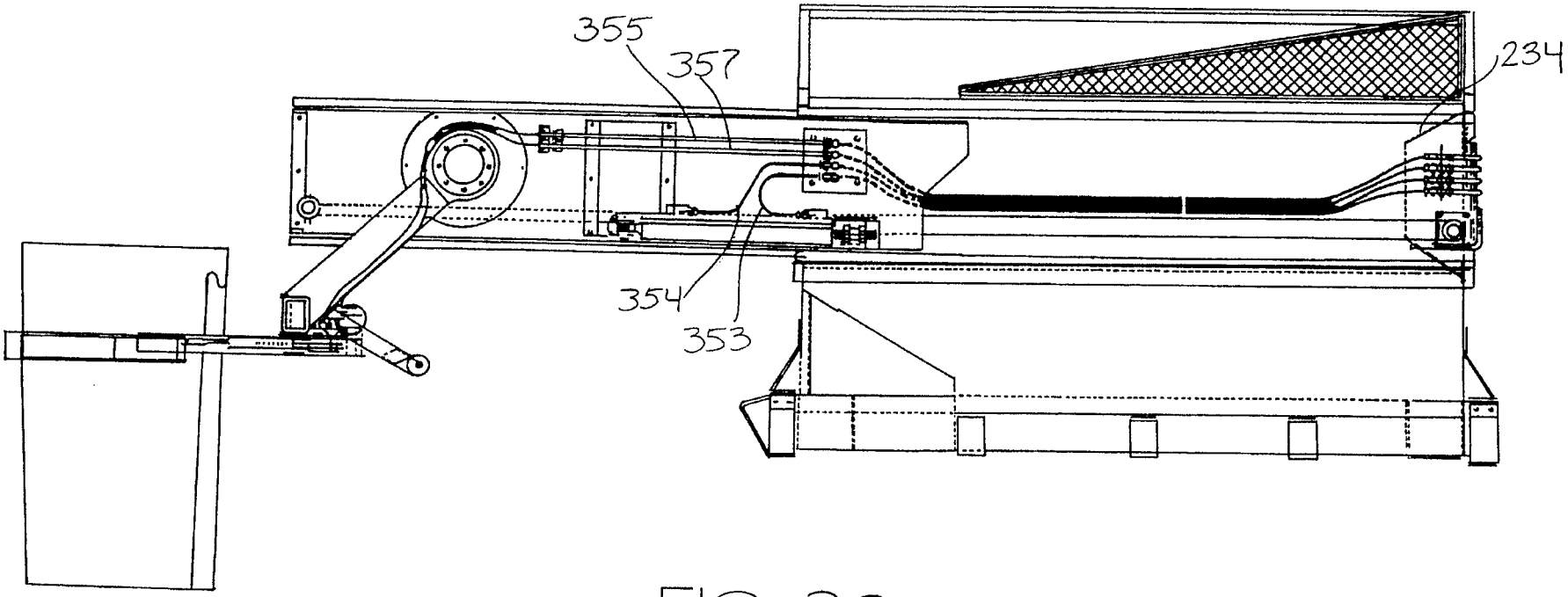
Figure 21:
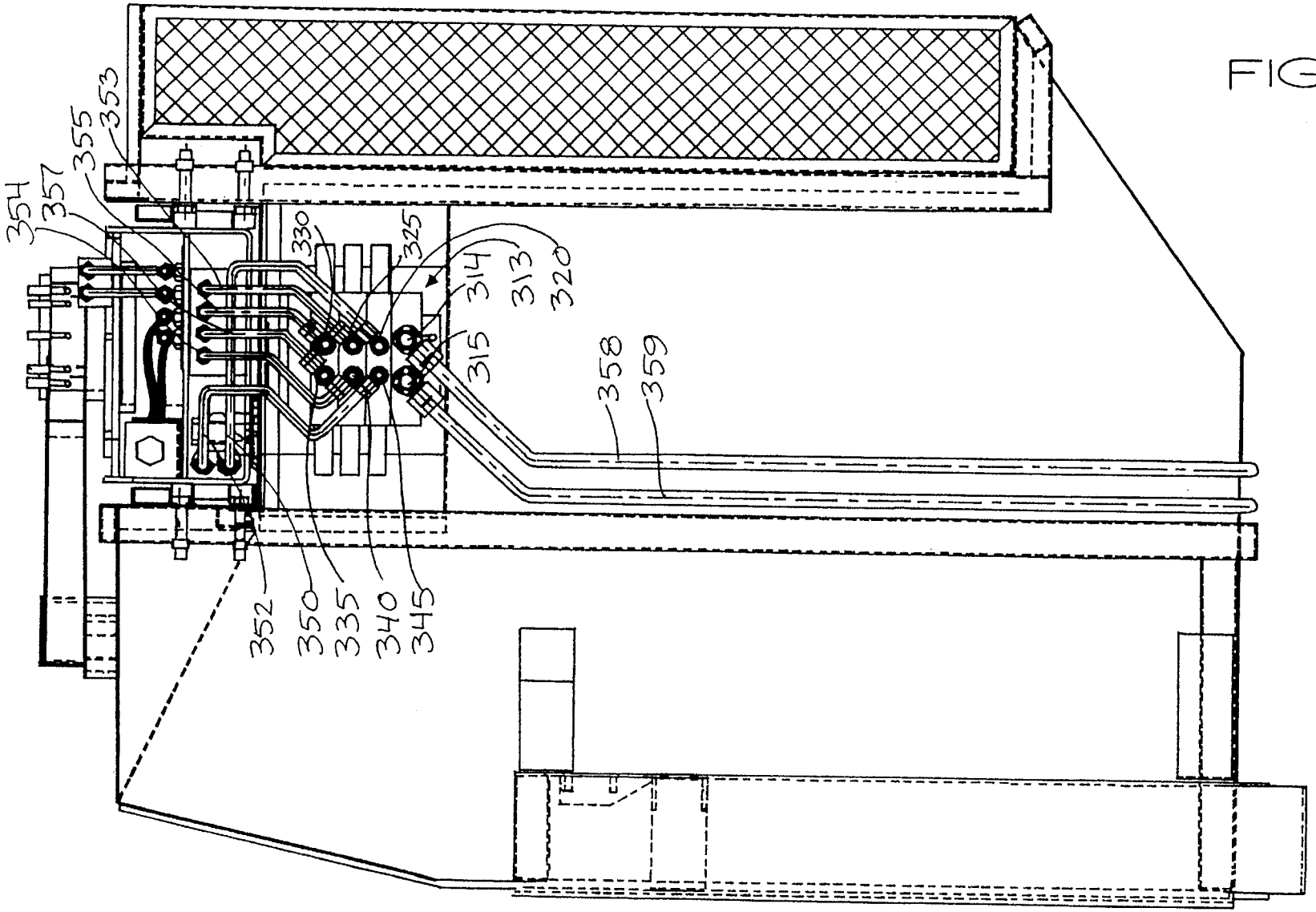
Figure 22:
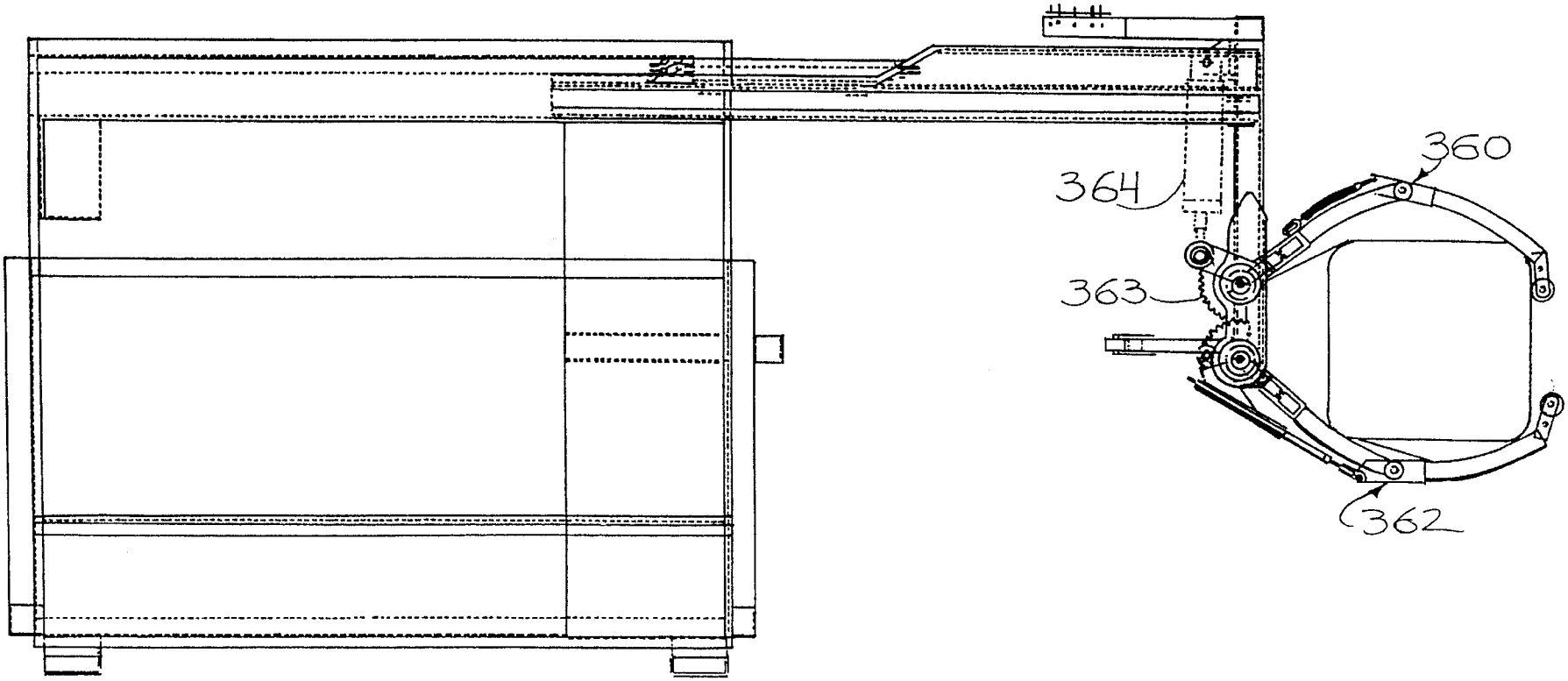

FIG. *7a–f* illustrate the steps involved in engaging and emptying a refuse container into the intermediate container of the present invention;

FIG. 8 is a perspective view of a remotely controlled intermediate container as it would appear carried by a front end loading refuse collection vehicle, and engaging a refuse container;

FIG. 9 is a partial exploded perspective view illustrating the remotely controlled intermediate container of FIG. 8, FIG. 10 is a perspective view of the remotely controlled intermediate container of FIGS. 8 and 9 with the motor powered assembly shown extended;

FIG. 11 is a perspective view of the remotely controlled intermediate container of FIGS. 8 and 9 with a motor powered assembly shown retracted;

FIG. 12 is a top view of the remotely controlled intermediate container;

FIG. 13 is a side view of the remotely controlled intermediate container as it would appear with the motor powered assembly extended;

FIG. 14 is a view taken along lines 14–14 of FIG. 12;

FIG. 15 is an exploded perspective view of the motor powered assembly;

FIG. 16 is a partial sectional elevational view of the motor powered dump assembly;

FIG. 17 is a partial elevational view of the motor powered dump assembly; 12 FIG. 18 is an elevational view of the motor powered dump assembly;

FIG. 19 is a schematic diagram of the remote control assembly;

FIG. 20 is a side view of the remotely controlled intermediate container as it would appear with the motor powered assembly extended, illustrating the remote control assembly;

FIG. 21 is a side view of the remotely controlled intermediate container, illustrating the remote control assembly; and FIG. 22 is a top view of the remotely controlled intermediate container as it would appear with the motor powered assembly extended, illustrating the remote control assembly.

DETAILED DESCRIPTION OF THE PREFERRED EMBODIMENT

Figure 1:
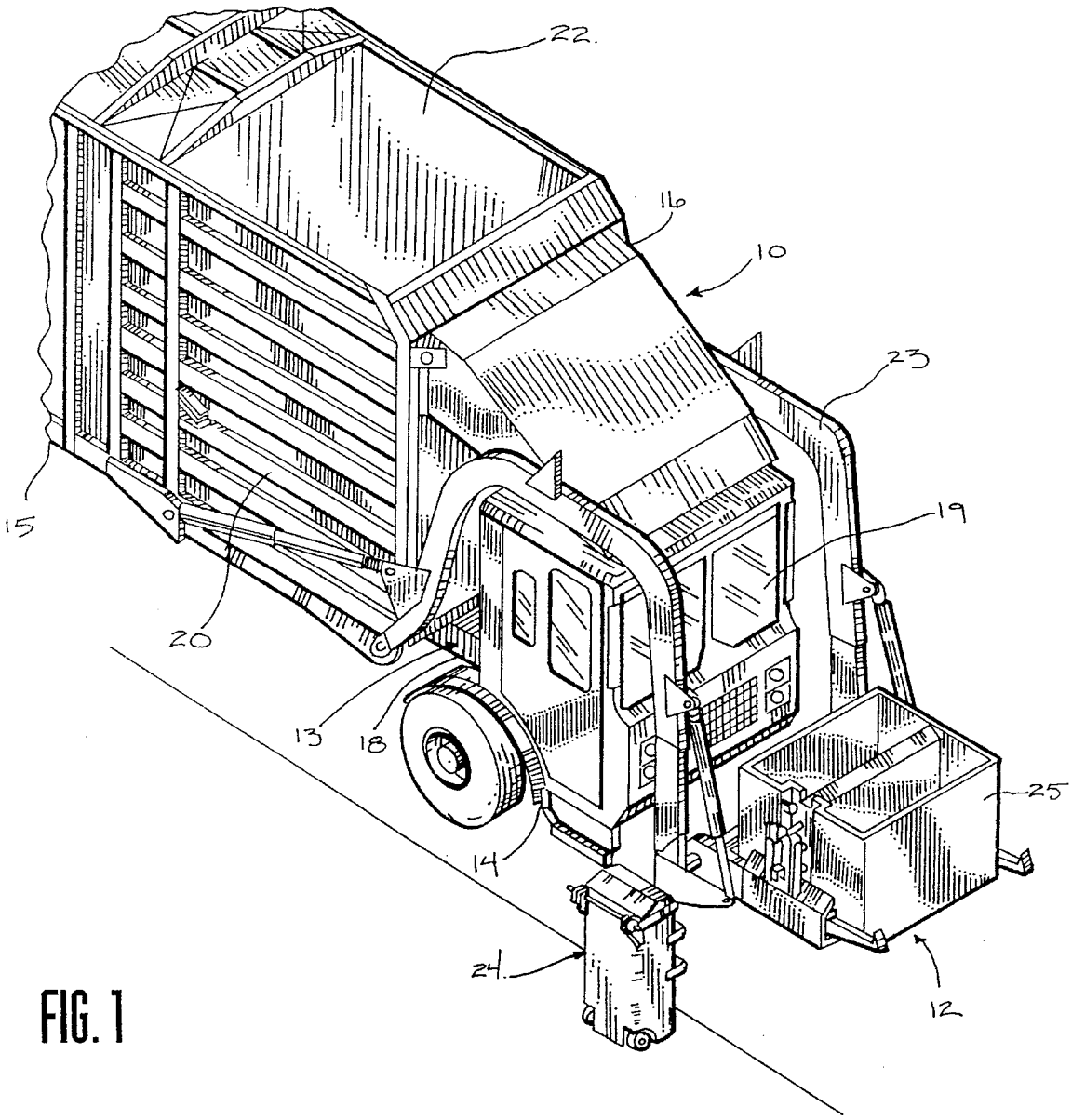
FIG. 1 is a perspective view of a refuse collection vehicle employing a sidearm assembly, constructed in accordance with the teachings of the instant invention, as it would appear immediately prior to engagement with a refuse container.

Turning now to the drawings in which like reference characters indicate corresponding elements throughout the several views, attention is first directed to FIG. 1 which illustrates a refuse collection vehicle generally designated 10 employing an automated intermediate container generally designated 12. Refuse collection vehicle 10 includes chassis 13, which, for purposes of orientation throughout the ensuing discussion, is considered to have a forward end 14, a rearward end 15, a left or street side 16, and a right or curb side 18. A cab 19 is carried at forward end 14 of chassis 13. A refuse collection body 20 is carried upon chassis 13 at a generally rearward location. Body 20 is a hollow refuse receiving and storage receptacle. A hopper 22 is integral with the forward portion of body 20. Hopper 22 receives refuse from automated intermediate container 12, and may contain a compactor (not shown) to compact the refuse and move it into body 20. However, those skilled in the art will understand that body 20 may simply be an open receptacle. A lift arm 23 pivotally coupled to body 20 and extending forward past cab 19, pivots about a fixed axis. In the lower position free end 21 of lift arm 23 is engageable with automated intermediate container 12. In the elevated position, lift arm 23 positions the automated intermediate container for dumping into hopper 22.

While FIG. 1 illustrates automated intermediate container 12 being used with a refuse collection vehicle 10 having body 20 and forwardly extending lift arms 23, those skilled in the art will understand that other refuse vehicles may be employed. For example, a refuse collection vehicle having a loading mechanism extending from the front back or sides may be used in combination with the automated intermediate container. Furthermore, a vehicle without a refuse collection body and only a lifting mechanism may also be used in combination with automated intermediate container 12. In this last instance, the vehicle would simply carry an automated intermediate container 12 for use as a portable refuse collection unit.

Figure 2:
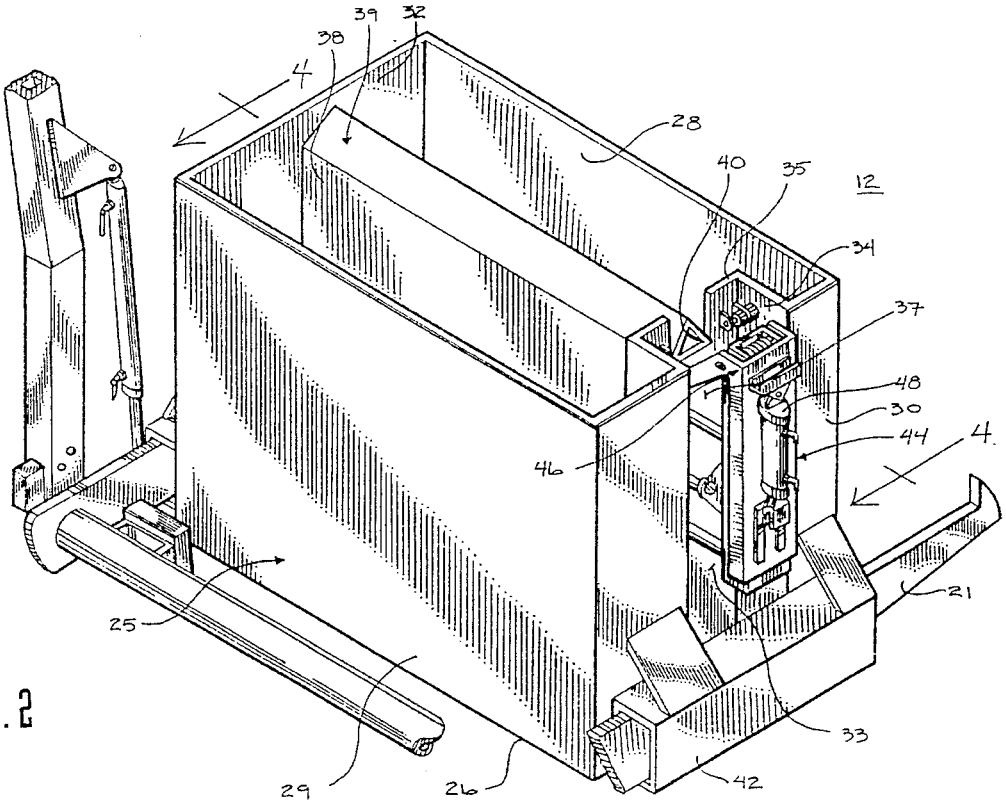
FIG. 2 is a perspective view of an automated intermediate container coupled to a lift mechanism.

Referring now to FIG. 2 automated intermediate container 12 is illustrated coupled to lift arm 23. Automated intermediate container 12 includes an intermediate container 25 having a bottom 26, a forward wall 28, a rearward wall 29, a curb side wall 30 and street side wall 32 forming a generally rectangular container having an open top. A recess 33 is formed in curb side wall 30, and defined by inwardly directed side walls 34 extending perpendicularly inwardly from curb side wall 30. Side walls 34 are joined by a recessed wall 35 recessed inwardly from and parallel to curb side wall 30.

Intermediate container 25 is divided by a pair of parallel spaced apart tunnel walls 38 defining a tunnel 36 therebetween. Tunnel walls 38 extend between recessed wall 35 and street side wall 32 parallel to forward wall 38 and rearward wall 29. The top of tunnel 37 is closed by a tunnel cover 39 having downward sloping sides 40, to prevent collection of refuse thereon.

Attachment members 42 are coupled to curb side wall 30 and street side wall 32 proximate bottom 26 for receiving free ends 21 of lift arm 23. Attachment members 42, in this embodiment, are square tubes extending substantially the width of curb side wall 30 and street side wall 32, and are configured to receive free end 21 of lift arm 23. The configuration of attachment members 42 allows automated intermediate container 12 to be easily attached to and detached from lift arms 23.

Figure 3:
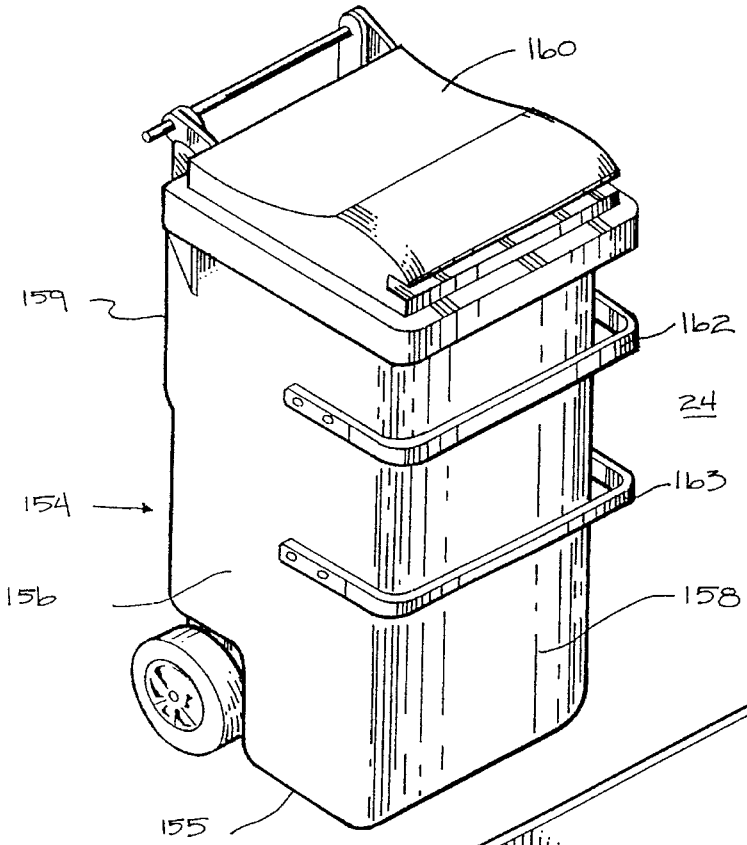
FIG. 3 is a perspective view of a refuse container for use with the automated intermediate container.
Figure 4:
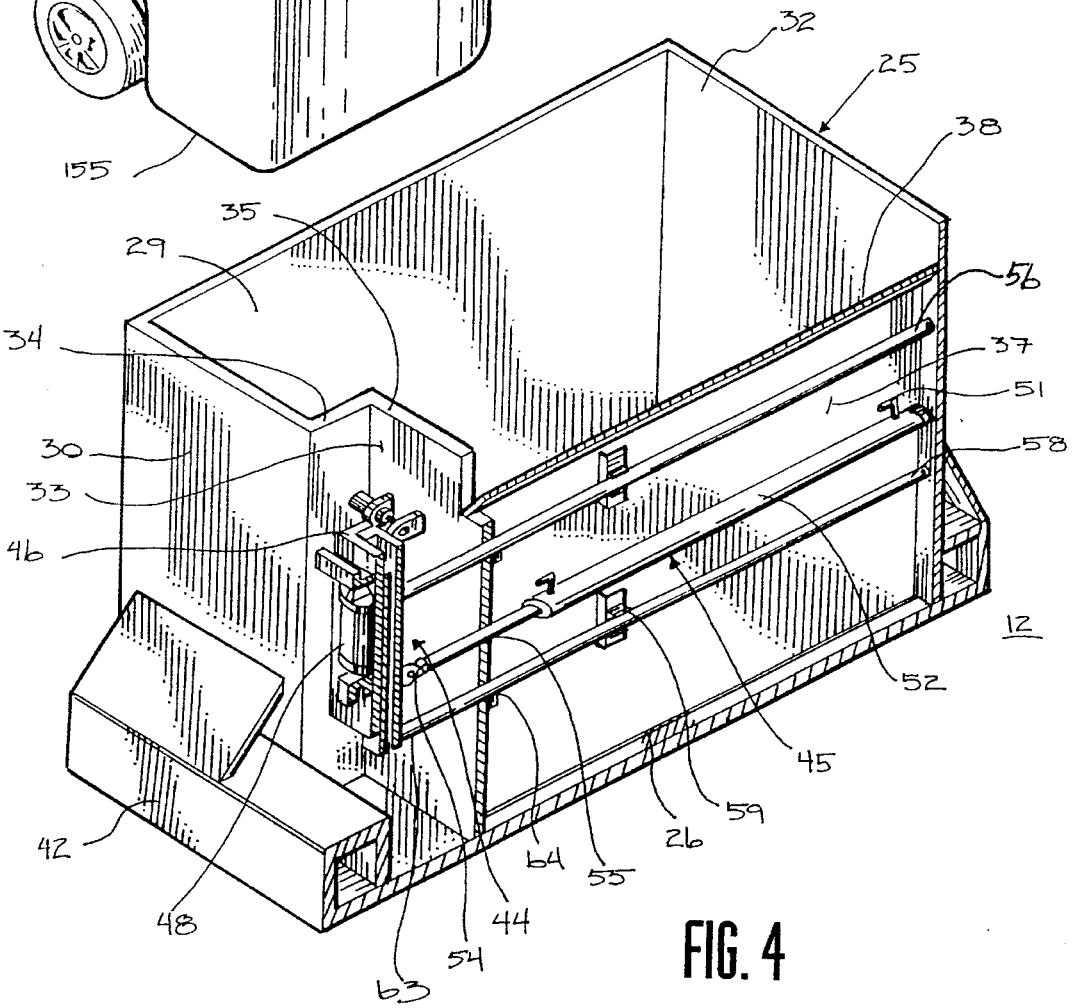
FIG. 4 is a cross sectional side view in perspective, taken along line 4—4 of FIG. 2.

With additional reference to FIG. 3, a sidearm assembly generally designated 44 is coupled to intermediate container 25 in recess 33. Side arm assembly 44 includes an extendible arm 45, a tilt assembly 46, and a grabber assembly 48. With further reference to FIG. 4, extendible arm 45 is extendible by an actuator, which in this preferred embodiment is a cylinder assembly 50. Cylinder assembly 50 includes a double acting cylinder 52 coupled to tunnel walls 38 inside tunnel 37, and a reciprocally movable operating rod 53 which is extendible or retractable in response to the introduction of pressurized fluid or gas into cylinder 52 through one of intake ports 51 in accordance with conventional practice. Operating rod 53 has a terminal end 54 extending into recess 33 through an opening 55 formed in recessed wall 35. Guide members 56 and 58 are mounted for reciprocal movement corresponding to operating rod 53. Guide members 56 and 58 are slidably mounted to side walls 34 using guides or pillow blocks 59. Guide member 56 is located in tunnel 37 above cylinder assembly 50 and has a terminal end 60 extending through an opening 62 in recessed wall 45. Guide member 58 is mounted below cylinder assembly 50, and has a terminal end 63 which extends into recess 33 through an opening 64 in recessed wall 35.

An end plate 70, generally configured as a rectangular tube, having sidewalls 71, a front or curb side surface 72, a back or street side surface 73, an upper end 74, and a lower end 75 is coupled to guide members 56 and 58, and to operating rod 53. Terminal end 60 and 63 of guide members 56 and 58 are attached to back surface 73 near upper end 74 and lower end 75 respectively. Terminal end 54 of operating rod 53 is coupled to back surface 73 of end plate 70 between guide members 56 and 58.

Figure 5:
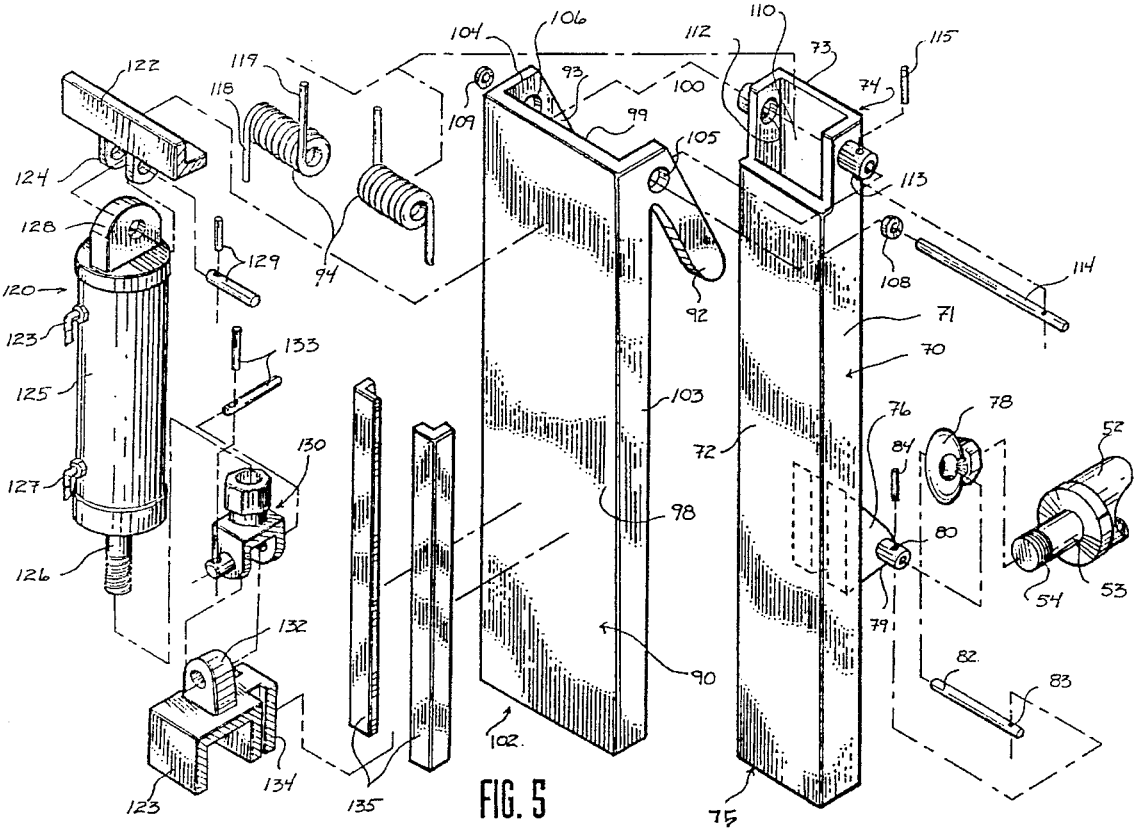
FIG. 5 is an exploded perspective view of the sidearm assembly of the present invention.

Referring now to FIG. 5, it can be seen that a bifurcated bracket 76 extends from back surface 73 of end plate 70 medially between upper end 74 and lower end 75. Terminal end 54 of operating rod 53 has an eye 78 coupled thereto. A collar 79 extends from bifurcated bracket 76, and has a pin hole extending therethrough. Eye 78 is secured in bifurcated brackets 76 by a shaft 82 extending through collar 79, bifurcated bracket 76 and eye 78. A pin hole 83 is formed in shaft 82 concentric with pin hole 80 in collar 79. A pin 84 inserted through pin hole 80 and pin hole 83 retains shaft 82 in bifurcated bracket 76.

A tilt assembly consisting of tilt plate 90 cams 92 and 93, and torsional springs 94 is pivotally coupled to the upper end 74 of end plate 70. Tilt plate 90, in this embodiment, is a channel beam having a front surface 98, a back surface 99, and upper end 100, a lower end 102 and two flanges 103 and 104 extending from back surface 99. Cams 92 and 93 extend outwardly from upper end 100 of flanges 103 and 104 respectively, at a downward angle. Shaft openings 105 and 106, formed at the junction of cams 92 and 93 with flanges 103 and 104 respectively, define the pivot point of tilt plate 90. Friction bearings 108 and 109, which may be bronze bushings, are receivable within shaft openings 105 and 106 respectively.

A recess 100 is formed in upper portion 74 of end plate 70 to house torsional springs 94. A bore 112 is formed through upper end 74 of end plate 70 through side walls 71, with tubular spacers 113 extending bore 112 outwardly from end plate 70. Back surface 99 of tilt plate 90 is placed flushed with front surface 72 of end plate 70, with flanges 103 and 104 overlapping side walls 71 of end plate 70 in a parallel spaced apart relation. Shaft openings 105 and 106 are concentric with bore 112. A shaft 114 is inserted through shaft openings 105 and 106 into bore 112. Shaft 114 also passes through and holds torsional springs 94 in recess 110. A pin 115 extends through tubular spacers 113 and shaft 114 to prevent movement of shaft 114.

Torsional springs 94 include an arm 118 which is anchored against the inner portion of front surface 72, and a spring arm 119 which contacts back surface 99 of tilt plate 90. When spring plate 90 is pivoted about shaft 114, torsional force builds up in torsional spring 94. The release of torsional force when torsional springs 94 relax pivots tilt plate 90 back to its lowered position.

A grabber assembly comprising a spreader actuator, which in this embodiment is a double acting cylinder 120, an upper grabber 122, and a lower grabber 123 is attached to the front surface 98 of tilt plate 90. Upper grabber 122 has an upper surface configured to engage a refuse container which will be described in greater detail below, and a lower surface from which projects a bifurcated mounting bracket 124. Cylinder assembly 120 includes a cylinder 125 and reciprocally movable operating rod 126 which is extendible or retractable in response to the introduction of pressurized fluid or gas to cylinder 125 through one of intake ports 127 in accordance with conventional practice. Cylinder 125 terminates at one end with attachment member 128. Attachment member 128 is secured to bifurcated bracket 124 by shaft and pin assembly 129. Operating rod 126 terminates at the free end with a threadably attached bifurcated bracket 170. Lower grabber 123 has a first end configured to engage a refuse container, flanges 134 extending from a side adjacent front surface 98, and an opposing end terminating in an attachment member 132 secured to bifurcated bracket 130 by a shaft and pin assembly 133. A slide track 135 is fastened proximate lower end 102 of tilt plate 90. Grabber assembly 48 is attached to front surface 98 of tilt plate 90 by attaching upper grabber 122 to front surface 98 proximate upper end 100 of tilt plate 90, and inserting flanges 134 extending from lower grabber 123 into slide track 135.

Figure 6:
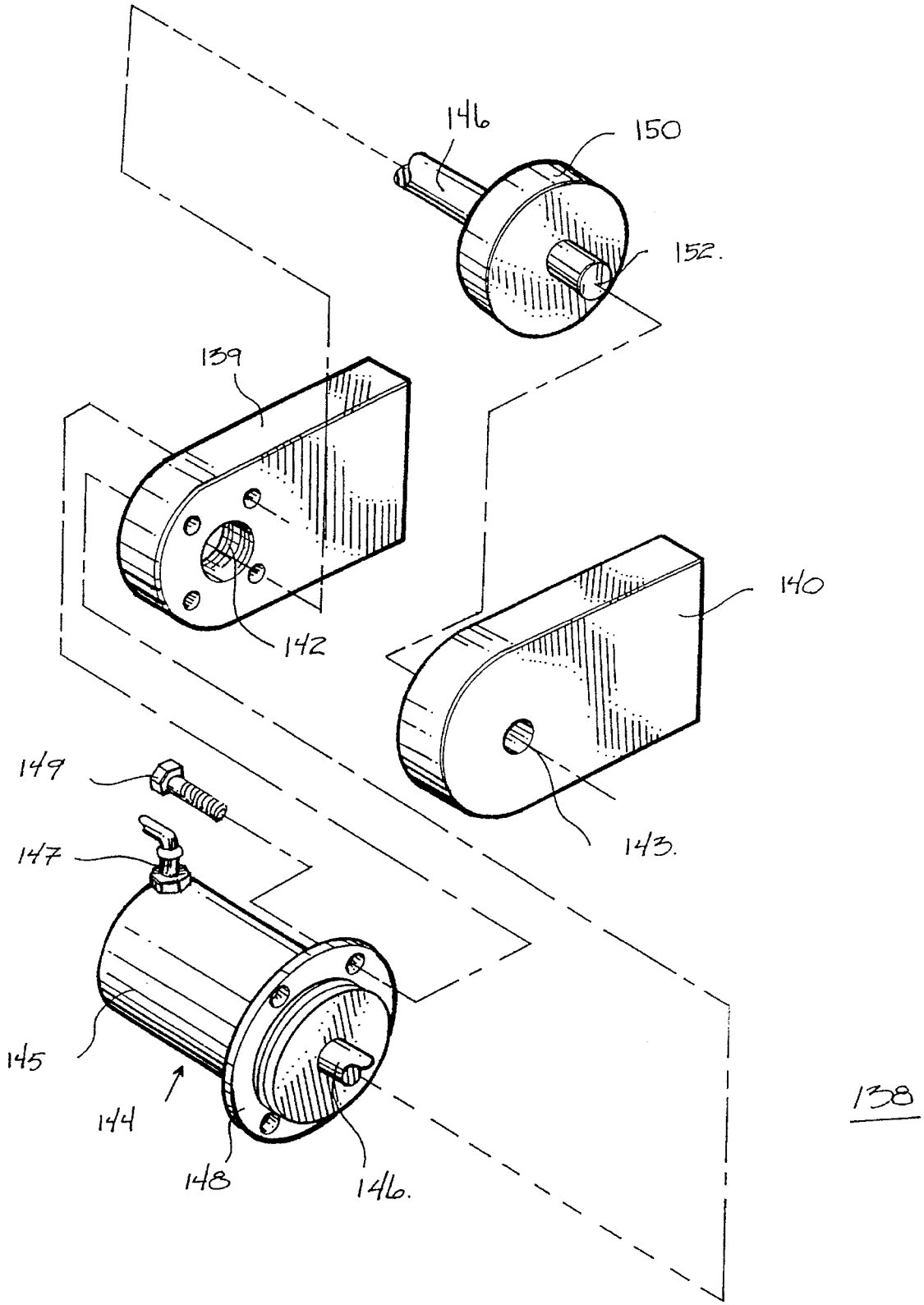
FIG. 6 is an exploded perspective view of a cam follower.
Figure 7:
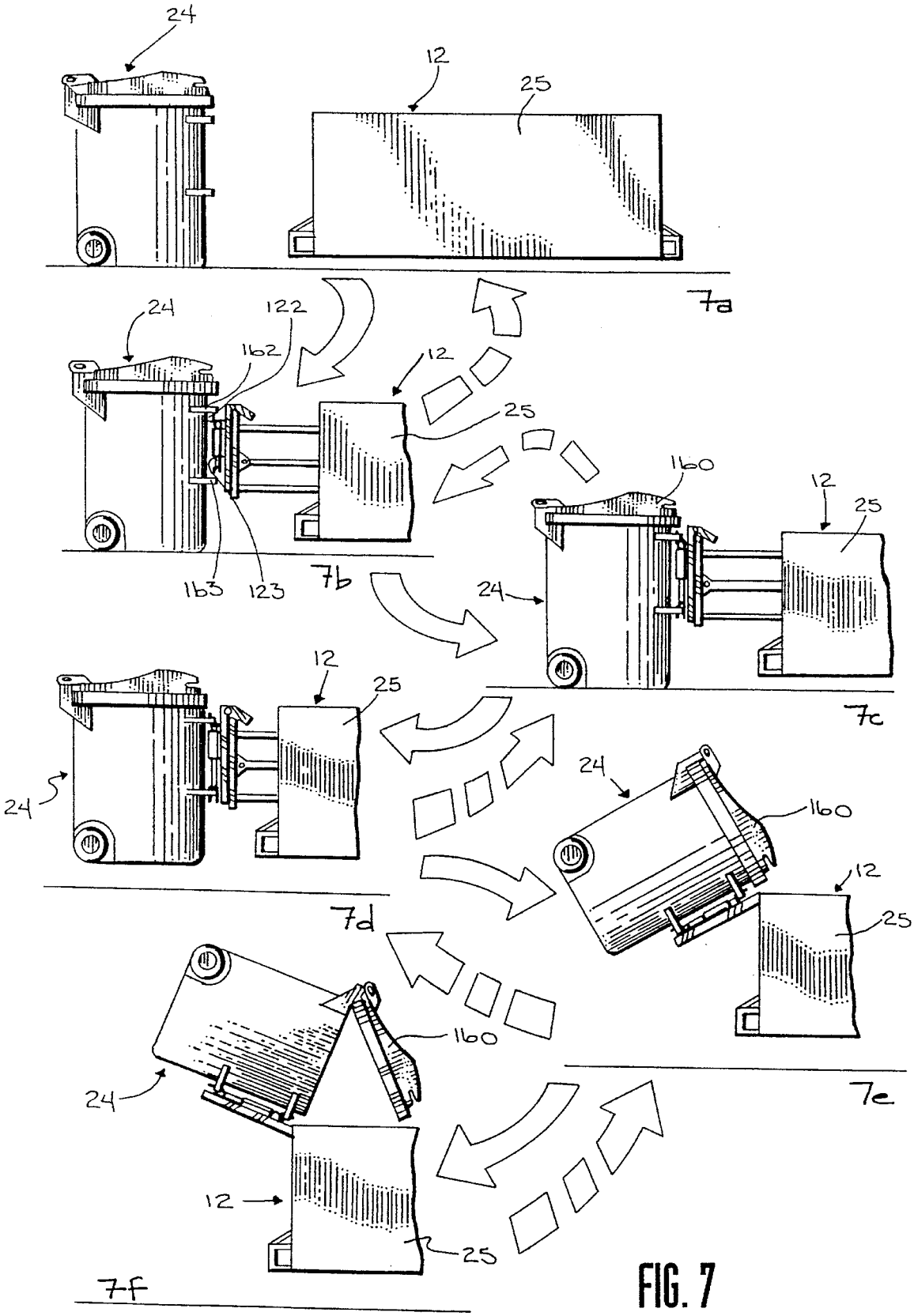

A pair of cam follower assemblies 138 one of which is illustrated in FIG. 6, are coupled to recessed wall 35 of recess 33, one on each side of extendible arm 45. For each cam follower assembly 138, an attachment member 139 and receiving member 140 extend from recess wall 35 in a parallel spaced apart relationship. A bore 142 extends through attachment member 139, and is concentric with a receiving bore 143 extending through receiving member 140. A cylinder assembly 144 is attached to each of attachment members 139. Each cylinder assembly 144 includes single acting cylinder 145 and reciprocating operating rod 146 which is extendible in response to the introduction of pressurized fluid or gas into cylinder 145 through intake port 147 in accordance with conventional practice. Cylinder 145 terminates, at an end from which reciprocating rod 146 extends, with an annular flange 148 secured to attachment member 139 by a set of bolts 149. Reciprocating rod 146 extends from cylinder 145 through bore 142, and carries cam follower 150 proximate its terminal end 152. With cylinder assembly 144 in its retracted position, a space exist between terminal end 152 of reciprocating rod 146. In response to the introduction of a pressurized fluid or gas into cylinder 145, reciprocating rod 146 is extended towards receiving member 140. When fully extended, terminal end 152 of reciprocating rod 46 is received in receiving bore 143. FIG. 6 illustrates a single cam follower assembly 138, however, two cam follower assemblies 138 are employed in the preferred embodiment, with a cam follower assembly 138 located on both sides of extendible arm 45.

It will be understood by those skilled in the art that while automated intermediate container 12 is illustrated in combination with a front loading refuse collection vehicle, any vehicle having a lift device may be used. Furthermore, those skilled in the art will understand that sidearm assembly 44 may be mounted in various locations on intermediate container 25. An example would be to mount sidearm assembly 44 on forward wall 28 with tilt assembly 46 and grabber assembly 48 offset towards rearward wall 29 to ensure that refuse container 24 is dumped into intermediate container 25.

Various means for controllably supplying pressurized hydraulic fluid or gas to the various actuating elements for operation of the structure of the instant invention will readily occur to those skilled in the art. The instant invention contemplates using conventional hydraulic systems and controls, which are considered to be apparent to those skilled in the art and therefore omitted so as not to unduly complicate the drawings.

Referring now to FIG. 3, refuse container 24, for use with automated intermediate container 12 is illustrated. Refuse container 24 consists of a body 154 having a bottom 155, side walls 156, a front wall 158, and a back wall 159. A cover 160 is hingedly attached to back wall 159 to close body 154. An upper grab bar 162 and a lower grab bar 163 are fixed to front wall 158 in a parallel spaced apart relationship. Grab bars 162 and 163 extend horizontally across and are outset from front wall 158. Grab bars 162 and 163 are generally placed in the middle of body 154 to approximate a balance point. Upper grab bar 162 and lower grab bar 163 are spaced apart a distance sufficient to permit grabber assembly 48, in its retracted position, to be inserted therebetween.

Referring now to FIG. *7a–f*, the steps in engaging and emptying refuse container 24 are illustrated. FIG. *7a* illustrates automated intermediate container 12 positioned adjacent refuse container 24, with sidearm assembly 44 in a retracted position. In its retracted position, sidearm assembly 44 fits into recess 33. Extendible arm 45 is fully retracted, with cams 92 and 93 disengaged from cam followers 150, which are retracted. Automated intermediate container 12 is maintained a given distance above the ground by lift arms 23. This allows refuse vehicle 10 to move without damaging automated intermediate container 12.

FIG. *7b* illustrates the extension of extendible arm 45 by activating cylinder assembly 50 which extends operating rod 53. Extendible arm 45 is extended until grabber assembly 48 is positioned between upper grab bar 162 and lower grab bar 163. Lift arms 23 are then raised a distance sufficient to engage upper grabber 122 with upper grab bar 162. Referring now to FIG. *7c*, cylinder assembly 120 is activated, extending operating rod 126. This engages lower grabber 123 to lower grab bar 163. The spreading of upper grabber 122 and lower grabber 123 securely attaches refuse container 24 to sidearm assembly 44.

Automated intermediate container 12 is then raised by raising lift arms 23, lifting refuse container 24 from the ground as illustrated in FIG. 70. When refuse container 24 has been lifted, extendible arm 45 is retracted by activating cylinder 52 and retracting operating rod 53. This draws refuse container 24 towards intermediate container 25. When extendible arm 45 is being retracted, cam followers 150 are placed in position to engage cams 92 and 93. This is accomplished by activating cylinder 145 causing rod 146 to extend and be received by receiving bore 143 of receiving member 140.

Referring now FIG. *7e*, extendible arm 45 is retracted until cams 92 and 93 contact cam followers 150. As extendible arm 45 continues to retract, cam followers 150 force cams 92 and 93 downward, swinging tilt plate 90 with attached refuse container 24 upward. When tilt plate 90 reaches the proper elevation, cover 160 of refuse container 24 swings open allowing refuse to empty from body 154. When tilt plate 90 swings upward, a torsional force is build up in torsional spring 94. To lower the refuse container 24, extendible arm 45 is again extended allowing cams 92 and 93 to disengage from cam followers 150. The relaxing of torsional spring 94 assist gravity in lowering tilt plate 90. Refuse container 24 is then replaced adjacent automated intermediate container 12 by the reversal of steps *7a* through *7f* as discussed above.

Referring now to FIG. 8, the present invention is further embodied in a remotely controlled intermediate container generally designated 200. Remotely controlled intermediate container 200 is generally similar to automated intermediate container 12, in that it is carried by a loader assembly 202 on a conventional refuse vehicle 203, and includes an intermediate container 204, and a motor powered assembly 205. Remotely controlled intermediate container 200 differs from automated intermediate container 12 in the construction of motor powered assembly 205 and the specific inclusion of a remote control assembly 207 (not visible).

Remotely controlled intermediate container 200 is received and carried by a lift arm 208 on refuse vehicle 203. Refuse vehicle 203 includes, for purposes of orientation throughout the ensuing description, a forward end 209, a rearward end 210, a left or street side 212, and a right or curb side 213. A cab 214 is carried at forward end 209. A refuse collection body (not shown) is carried rearward of cab 214. Refuse vehicle 203 is generally representative of conventional front loading refuse collection vehicles and is therefore not described in great detail.

Lift arm 208 is pivotally coupled to refuse vehicle 203 at one end 215, and includes a free end 217 extending forwardly past cab 214. Lift arm 208 pivots about a fixed axis, carrying remote controlled intermediate container 200 over cab 214. It will be understood that lift arm 208 is of conventional construction, and is a generally parallel construction with free end 217 being two substantially parallel engagement members 218 forming a generally fork shaped extension. Lift arm 208 is selectively movable between an elevated position and a lowered position. In the lower position engagement members 218 of lift arm 208 are engageable with remotely controlled intermediate container 200. In the elevated position, lift arm 208 positions remotely controlled intermediate container 200 for emptying.

Still referring to FIG. 8, remote controlled intermediate container 200 is illustrated coupled to lift arm 208. Intermediate container 204 includes a bottom 219, a forward wall 220, a rearward wall 222, a curb side wall 223 and street side wall 224 forming a generally rectangular container having an open top. A recess 225 is formed in curb side wall 223 proximate bottom 219, and a reinforced channel 227 is formed in forward wall 220, intermediate bottom 219 and the open top and extending from curb side wall 223 to street side wall 224. With additional reference to FIG. 9, it can be seen that motor powered assembly 205 is carried within channel 227 and includes an extendible arm 228, an engagement assembly 229 and a dumping assembly 230. Extendible arm 228 is extendible past curb side wall 223 to position engagement assembly 229 adjacent a refuse container 232 presented at curbside for pick-up. Engagement assembly 229 may be substantially any of a wide variety of types but is preferably a gripping mechanism such as described in U.S. Pat. No. 5,209,537 or that which is specifically illustrated in FIG. 22.

Turning now to FIG. 10, intermediate container 204 includes attachment members 233 formed in bottom 219 proximate curb side wall 223 and street side wall 224, for receiving engagement members 218 of lift arm 208. Attachment members 233, in this embodiment, are square tubes extending from rearward wall 222 to a point intermediate rearward wall 222 and forward wall 220. Attachment members 233 are configured to receive engagement members 218 of lift arm 208. The configuration of attachment members 233 allow remote controlled intermediate container 200 to be easily attached to and detached from lift arm 208. An additional element of intermediate container 204, is a control box 234 formed in street side wall 224. Box 234 carries the couplings used for performing the remote control of motor powered assembly 205, and will be described in detail below.

Referring now to FIGS. 11 and 12, engagement assembly 229 must be stored safely during movement of the refuse collection vehicle between refuse container pick-up. If engagement assembly 229 extends past curb side wall 223 in a curbside direction by any substantial distance, it can present a hazard. Besides being damaged, engagement assembly 229 may damage parked cars or other obstructions and may be hazardous to pedestrians. In this embodiment, engagement assembly 229 is retracted within recess 225 formed in curb side wall 223 as illustrated by broken lines. Preferable, engagement assembly 229 includes opposed gripping members which reticulate to a spread apart position having reduced depth, which will nest within recess.

Turning now to FIGS. 13 and 14, it can be seen that reinforced channel 227 supports motor powered assembly 205. Motor powered assembly 205 includes extendible arm 228 having a track 237 fixedly attached to intermediate container 204 within channel 227, an extendible element 238 having an end 239 and 240, slideable received within track 237 for selective movement between a retracted position and an extended position and a hydraulic cylinder 242 for moving extendible element 238 upon demand. It will be understood that hydraulic cylinder 242 may be substantially any motor such as a pneumatic cylinder, electric motor, etc. Dump assembly 230 is carried by extendible element 238 proximate end 240 and includes a rotateable arm 243 having an end 244 pivotally coupled to extendible element 238 proximate end 240 and an opposing end 245 configured to be coupled to engagement assembly 229. Arm 243 is selectively pivotable between a lowered position and a dump position. As can be seen, extendible element 238 is selectively movable to an extended position, wherein engagement assembly 229 is positioned to engage a refuse container. Upon moving extendible element 238 to the retracted position, dump assembly 230 may be actuated, pivoting arm 243 to the dump position as illustrated by broken lines 247, emptying the refuse container into intermediate container 204.

Turning now to FIG. 15, motor powered assembly 205 can be seen in detail. Track 237 of extendible arm 228 includes a generally U-shaped member 248 having a curb end 249, a street end 250, a top flange 252, a bottom flange 253 and a wall 256 extending therebetween. A pair of parallel spaced apart guides 254 and a pair of parallel guides 255 are coupled to flanges 252 and 253 respectively, within U-shaped member 248, extending from end 249 to end 250 to retain and guide extendible element 238. A pair of fastening members 257, preferably bolts, extend through each of flanges 252 and 253 at each end 249 and 250, securely fastening track 237 to intermediate container 204 within channel 227.

Extendible element 238 includes a generally U-shaped member 258 having a curb end 261, a street end 266, a top flange 259, a bottom flange 260 and a wall 262 extending therebetween, and guides 263 and 264 carried by the outer surface of flanges 259 and 260 respectively. Each of guides 263 and 264 are positioned so as to be received between pairs of guides 254 and 255 of track 237, respectively, retaining extendible element 238 within track 237 and guiding extendible element 238 between the extended and retracted positions. An intermediate bulkhead 265 extends from end 261 to end 266 between flanges 259 and 260 in a parallel spaced apart relationship with wall 262, forming a cavity 267 therebetween. An opening 268 is formed through wall 262 corresponding to an opening 269 formed through bulkhead 265. A cover plate 270 having an opening 272, corresponding to openings 268 and 269, extends from end 261 to a position intermediate end 261 and end 266, between flanges 259 and 260 in a parallel spaced apart relationship with bulkhead 265, forming a cavity 273 therebetween. An end cap 274 closes end 261 of cavities 267 and 273, and the opposing end of cavity 273 is closed by a plate 275 coupled between cover plate 270 and bulkhead 265.

Hydraulic cylinder 242, preferably double acting, has an end 277 coupled to U-shaped member 248 proximate end 250 intermediate flanges 252 and 253 by a coupling 278 consisting of a threaded socket member 279 affixed to wall 256 and a bolt 280 received thereby. End 277 is spaced from wall 256 by a spacer 282 to align end 277 with opposing end 276 which is coupled to extendible element 238. Cylinder 242 extends through cavity 267, passes below opening 268 and is coupled to end 261 of extendible element 238 by a pin 283. Upon actuation, as will be discussed in the subsequent specification, cylinder 242 moves extendible element 238 outward toward the curb side along track 237.

Still referring to FIG. 15, with additional reference to FIGS. 16 and 17, dump assembly 230 is carried by extendible element 238 proximate end 261, and includes arm 243 rotateable by the combination of a linear gear 287 and a rotary gear 288 which translate linear motion into rotary motion. Linear gear 287 and rotary gear 288 may be a chain and sprocket arrangement as shown, a rack and pinion arrangement, etc. The chain and sprocket arrangement is preferred as alignment and tolerances are not critical and this arrangement will operate in extreme environments of dirt and detritus. Rotary gear 288 is carried within cavity 273 by a hub 289 extending, in one direction, into cavity 283 and in the opposing direction out through cover plate 270. A collar plate 290 is coupled to cover plate 270 and includes an opening 292 sized to receive and aid in aligning hub 289. Rotary gear 288 and hub 289 are held in position within extendible element 238 by a plurality of bearings, including a journal bearing 293 carried in openings 268 and 269 and a journal bearing 294 carried in opening 292 of collar plate 290, both receiving hub 289. To prevent translational movement within extendible element 238, a thrust bearing 295 is received about hub 289, positioned between rotary gear 288 and bulkhead 265, and a thrust bearing 297 is received about hub 289, positioned between rotary gear 288 and cover plate 270. End 244 of arm 243 is attached to hub 289 by nuts coupled to a plurality of studs 298 extending therefrom.

Still referring to FIG. 15, with additional reference to FIG. 18, rotary gear 288 is driven by linear gear 287. Linear gear 287 is carried by a carriage 300 reciprocally movable on a track 302. A friction bearing 304 is carried between track 302 and carriage 300. Track 302 is mounted in cavity 273 coupled to bottom flange 260. In this specific embodiment, linear gear 287 is a chain attached by welding to carriage 300. Chain receives teeth of rotary gear 288, translating its linear motion to a rotary motion of rotary gear 288. A linear motion is imparted to linear gear 287 by a double acting hydraulic cylinder 303 coupled between carriage 300 and a bracket 305 attached to flange 260 and bulkhead 265 proximate end 266. Upon demand, cylinder 303 moves linear gear 287 toward end 261, rotating arm 243 to the dump position.

Turning to FIG. 19, remote control assembly 207 includes a joy stick designated by box 310, mounted in cab 214 for providing input for the desired action of motor powered assembly 205. Control relays designated by box 312, also mounted in cab 214, provide power to the joy stick. In this specific embodiment, six lines extend from joystick (box 310) to hydraulic valve control 313 carried by intermediate container 204. Hydraulic valve control 313 include solenoid powered by the lines which open corresponding valves to power the various motors described previously. Pressurized hydraulic fluid is supplied to the valves from a tank input 314 and pump input 315. In this embodiment, a line 317 is coupled to solenoid 318 which, when selected by the joystick, opens a valve 319 allowing pressurized fluid to flow to cylinder 242 through outlet 320, retracting extendible element 238. A line 322 is coupled to solenoid 323 which, when selected by the joystick, opens a valve 324 allowing pressurized fluid to flow to cylinder 303 through outlet 325, rotating arm 243 to the dump position. A line 327 is coupled to solenoid 328 which, when selected by the joystick, opens a valve 329 actuating a motor in engagement assembly 229 through outlet 330, to engage a refuse container. A line 332 is coupled to solenoid 333 which, when selected by the joystick, opens a valve 334 allowing pressurized fluid to flow to a motor through outlet 335, disengaging a refuse container. A line 337 is coupled to solenoid 338 which, when selected by the joystick, opens a valve 339 allowing pressurized fluid to flow to cylinder 303 through outlet 340, rotating arm 243 to the lowered position. A line 342 is coupled to solenoid 343 which, when selected by the joystick, opens a valve 344 allowing pressurized fluid to flow to cylinder 242 through outlet 345, retracting extendible element 238 to the retracted position. A line 347 couples each of the solenoids to a ground 348 in the control relay (box 312). It will be understood that pressure limiters may be placed on some or all of the valves, to limit the pressure supplied to the various cylinders. A limiting switch 349, preferably a whisker switch, is carried by intermediate container 204, and is open when motor powered assembly 205 is in a stowed configuration. The stowed configuration is with extendible element 238 retracted, arm 243 in the lowered position, and engagement assembly 229 open and retracted into recess 225. When limiting switch 249 is closed, and an attempt is made to raise loader assembly 202, an alarm or other signal is activated or an automatic cut-off is activated preventing raising of loader assembly 202.

Turning now to FIGS. 20 and 21, hydraulic conduits are shown extending from valve control 313 carried in control box 234. A pair of conduits 350 and 352 extend from outlets 320 and 345 and couple to cylinder 242. A pair of conduits 353 and 354 extend from outlets 325 and 340, down track 237, and couple to cylinder 303. A pair of conduits 355 and 357 extend from outlets 330 and 335, down track 237, through extendible element 238, down arm 243 and couple to a motor located in engagement assembly 229. Conduits 358 and 359 couple a reservoir (not shown) and a pump (not shown) to inlets 314 and 315 respectively supplying pressurized fluid upon demand.

FIG. 22 illustrates an embodiment of engagement assembly 229, including a pair of opposed reticulated arms 360 and 362. Gears 363 couple arms 360 and 362 and a cylinder 364 actuates arm 360 and thus arm 362. In their fully open position, arms 360 and 362 will easily fit within recess 225, with arm 360 extending substantially parallel thereto, and arm 362 doubled over.

Various changes and modifications to the embodiment herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

1. A remote controlled intermediate container in combination with a refuse vehicle, wherein said refuse vehicle includes a forwardly extending lift mechanism suitable for lifting a front loader refuse container, said remote controlled intermediate container comprising:

an intermediate container removably carried by said lift mechanism;

said intermediate container having support means for supporting said intermediate container on said forwardly extending lift mechanism;

a motor powered assembly including an extendible arm to the curb side of the vehicle, coupled to said intermediate container, and having a terminal end, a dump assembly coupled to said extendible arm proximate said terminal end, and an engagement assembly coupled to said dump assembly, said extendible arm further including:

a track carried by said intermediate container;

an extendible element slidably carried by said track and reciprocally movable between a retracted position and an extended position; and a motor, actuated by said remote control assembly, coupled between said track and said extendible element for selectively moving said extendible element between said retracted position and said extended position; and a remote control assembly for controlling said motor powered assembly from said refuse vehicle.

2. A remote controlled intermediate container as claimed in claim 1 wherein said dump assembly further comprises:

a linear gear reciprocally movable in a linear motion;

a motor, actuated by said remote control assembly, for imparting said linear motion to said linear gear;

a rotary gear in mesh with said linear gear for translating said linear motion to a rotary motion; and an arm having a first end coupled to said rotary gear and a second end coupled to said engagement assembly.

3. A remote controlled intermediate container as claimed in claim 1 wherein said remote control assembly further comprises:

input means mounted in a cab of said vehicle for inputting desired actions of the motor powered assembly;

control relays mounted in the cab for supplying power to said input means; and supply means for supplying power to motor powered assembly as directed by input means.

4. A remote controlled intermediate container in combination with a refuse vehicle, wherein said refuse vehicle includes a forwardly extending lift mechanism suitable for lifting a front loader refuse container, said remote controlled intermediate container comprising:

an intermediate container removably carried by said lift mechanism;

said intermediate container having support means for supporting said intermediate container on said forwardly extending lift mechanism;

a motor powered assembly including an extendible arm extendible to the curb side of the vehicle and coupled to said intermediate container, a dump assembly coupled to said extendible arm, and an engagement assembly coupled to said dump assembly;

said extendible arm further includes:

a track carried by said intermediate container;

an extendible element slidably carried by said track and reciprocally movable between a retracted position and an extended position;

a motor, actuated by said remote control assembly, coupled between said track and said extendible element for selectively moving said extendible element between said retracted position and said extended position; and a remote control assembly for controlling said motor powered assembly from said refuse vehicle.

5. A remote controlled intermediate container as claimed in claim 4 wherein said dump assembly further comprises:

a linear gear reciprocally movable in a linear motion;

a motor, actuated by said remote control assembly, for imparting said linear motion to said linear gear;

a rotary gear in mesh with said linear gear for translating said linear motion to a rotary motion; and an arm having a first end coupled to said rotary gear and a second end coupled to said engagement assembly.

* * * * *